US007019466B2

(12) United States Patent
Bätz

(10) Patent No.: US 7,019,466 B2
(45) Date of Patent: Mar. 28, 2006

(54) CIRCUIT ARRANGEMENT FOR DRIVING A HIGH-PRESSURE DISCHARGE LAMP

(75) Inventor: Walter Bätz, Sindelsdorf (DE)

(73) Assignee: Patent-Treuhand-Gesellschaft fur Elecktrisch Gluhlampen mbH, Munich (DE)

( * ) Notice: Subject to any disclaimer, the term of this patent is extended or adjusted under 35 U.S.C. 154(b) by 14 days.

(21) Appl. No.: 10/874,214

(22) Filed: Jun. 24, 2004

(65) Prior Publication Data

US 2005/0001559 A1 Jan. 6, 2005

(30) Foreign Application Priority Data

Jul. 3, 2003 (DE) ..... 103 30 117

(51) Int. Cl.
*H05B 37/00* (2006.01)

(52) U.S. Cl. ..... 315/288; 336/170

(58) Field of Classification Search ..... 315/288, 315/291, DIG. 5, DIG. 2; 336/170, 213, 336/221

See application file for complete search history.

(56) References Cited

U.S. PATENT DOCUMENTS

| | | | | |
|---|---|---|---|---|
| 3,732,460 | A * | 5/1973 | Wattenbach | 315/123 |
| 6,624,581 | B1 * | 9/2003 | Daub et al. | 315/58 |
| 6,642,827 | B1 * | 11/2003 | McWilliams et al. | 336/107 |
| 2005/0035729 | A1 * | 2/2005 | Lev et al. | 315/291 |

* cited by examiner

*Primary Examiner*—Thuy Vinh Tran
(74) *Attorney, Agent, or Firm*—Carlo S. Bessone

(57) ABSTRACT

A circuit arrangement has a first input terminal for a first voltage potential; a second input terminal for a second voltage potential; a third input terminal for feeding a starting voltage; a first electrical connection, which provides at its first end a first output terminal for a high-pressure discharge lamp, and which is coupled at its second end to the first input terminal for the first voltage potential; a second electrical connection, which provides at its first end a second output terminal for a high-pressure discharge lamp, and which is coupled at its second end to the second input terminal for the second voltage potential; a first inductor arranged in the second electrical connection; and a starting device coupled on the input side at least to the third input terminal for feeding a starting voltage, and on the output side to one of the output terminals, and a second inductor together with a first inductor.

12 Claims, 7 Drawing Sheets

CIRCUIT ARRANGEMENT FOR DRIVING A HIGH-PRESSURE DISCHARGE LAMP

FIELD OF THE INVENTION

The present invention relates to a circuit arrangement for driving a high-pressure discharge lamp having a first input terminal for a first voltage potential, a second input terminal for a second voltage potential, a third input terminal for feeding a starting voltage, a first electrical connection, which provides at its first end a first output terminal for a high-pressure discharge lamp, and which is coupled at its second end to the first input terminal for the first voltage potential, a second electrical connection, which provides at its first end a second output terminal for a high-pressure discharge lamp, and which is coupled at its second end to the second input terminal for the second voltage potential, a first inductor that is arranged in the second electrical connection, and a starting device that is coupled on the input side at least to the third input terminal for feeding a starting voltage, and that is coupled on the output side to one of the output terminals for the high-pressure discharge lamp.

BACKGROUND OF THE INVENTION

High-pressure discharge lamps are used, for example, in automobiles. In the ignited state they are operated, for example, with the aid of a rectangular signal with a frequency of 400 Hz. Disturbances in the FM band can occur at 70 to 120 MHz if such a signal has steep edges. The disturbances arise on the line, that is to say they are so-called conducted disturbances. Recently, more and more automobile manufacturers have gone over to implementing specific operating elements without direct mechanical or hydraulic connection between the user interface and the action location, instead of supplying for a user an input unit in the case of which the signals input therein are converted into electrical signals that are subsequently transmitted via a bus system to an actuator which then undertakes the appropriate activity. This development is familiar under the term "drive-by-wire", and is used, for example, in the steering, the brake and the gas pedal of a motor vehicle. It is evident here that no disturbances of any kind may be allowed to occur, since malfunctions could initiate disastrous consequences. In the prior art, an inductor has been introduced for this purpose into the return conductor in the case of circuit arrangements of the generic type for high-pressure discharge lamps. FIG. 1 shows a high-pressure discharge lamp 10, the associated drive circuit being accommodated in the block 12. The input 1 denotes the forward line, input 2 the return line and input 4 the starting line. Arranged inter alia in the block 12 is the starting device. The high-pressure discharge lamp 14, which is cast into a glass cladding 16, has a return line 18 that is insulated by means of a ceramic tube 20. A typical starting voltage is at approximately 23 kV DC, a typical operating voltage is 85 V AC, the frequency being, for example, 400 Hz.

In the known circuit arrangement, conducted disturbances are certainly reliably prevented, but the return conductor voltage of the high-pressure discharge lamp is increased by the inductance. In the event of starting voltages of up to 25 kV, the return conductor voltage can become so high, in particular directly after starting, that it can jump over onto the reflector of the assigned headlight. Because of the high voltages occurring, there is therefore the risk of injury to automobile mechanics or home mechanics who may be accidentally in contact with the reflector when the discharge lamp is switched on. Because of the high temperatures occurring—for example, a typical value of the temperature of the discharge vessel is 700° C., which means that a return conductor in the vicinity is still heated to 550° C.—it is not possible to use any plastic insulations. What are used, for example, are ceramic tubes that for their part must have play, since it is necessary to take account of the expansion at high temperatures and which, on the other hand, can easily break such that the return conductor is entirely unprotected. As shown in FIG. 1, a part of the return conductor itself normally remains entirely uninsulated even given an intact ceramic tube. A further disadvantage of the known solution consists in that the starting voltage provided for the lamp is split between the lamp and the inductor arranged in the return conductor. Again, the starting energy that is available in the lamp for the further starting operation after a flashover caused by the starting voltage is reduced in the prior art. It follows that only a reduced starting voltage and starting energy are available for the lamp, the result being worsening of the starting reliability of the lamp.

It is therefore the object of the present invention to develop a circuit arrangement of the generic type in such a way that the risk of injury is reduced while the required operational reliability is maintained, and a higher starting reliability can be ensured than with the solution known from the prior art.

SUMMARY OF THE INVENTION

The invention is based on the findings that no voltage occurs on the return conductor when a further inductor is arranged in the forward conductor and both inductors form a current-compensated choke, a so-called common mode choke, since the latter does not constitute an inductance for the useful current. Consequently, the useful current is not influenced at any time. It follows from this, firstly, that no high return conductor voltage occurs as a consequence of the useful current and, secondly, that no impairment of the starting reliability of the lamp takes place thereby.

In the case of a current-compensated choke, two windings are made on a core, the winding sense being selected such that the magnetic field lines that are produced by currents through two windings are oppositely directed. If two currents of equal magnitude now flow through two windings in opposite directions, their magnetic field lines cancel each other reciprocately, and so no voltage is induced.

The first voltage potential usually constitutes a supply voltage, while the second voltage potential constitutes electrical ground. As is evident to the person skilled in the art, the inventive success can also be achieved with the aid of another selection of the voltage potentials.

The first electrical connection usually constitutes a forward line, while the second electrical connection constitutes a return line. The first voltage potential constitutes a DC voltage before starting, and an AC voltage after starting.

The second inductor is preferably arranged between the terminal from the first voltage potential and the starting device, or between the starting device and the terminal for the high-pressure discharge lamp, which is coupled to the starting device.

The first inductor and the second inductor preferably comprise electrical wires that are wound onto a common ferrite core. There is thus no need for an additional coil form, and this results in space saving as is desired above all in automobile headlights. Such ferrite cores can operate, furthermore, in the high-temperature range, that is to say at 150° C. plus their self-heating. The ferrite core is preferably produced from highly insulating material. The wires can thereby have copper enamel as sole insulation. Since further insulations can be eliminated, this also results, in turn, in space saving.

In a further preferred exemplary embodiment, arranged in the electrical connection between the terminal for feeding a starting voltage and the assigned terminal for the high-pressure discharge lamp is a third inductor which is magnetically coupled to the first and the second inductors. The return conductor is usually connected to the forward conductor via a diode branch. The latter serves for safety. For reasons of operational reliability of the operating equipment of the lamp (EB, electronic ballast), it must be ensured that the voltage between first input terminal 1 and second input terminal 2 is always smaller than 1000 V. Owing to the parasitic capacitance of the diodes, an interference current flows from the return conductor to the forward conductor and via the capacitor C1, which constitutes a short circuit for radio-frequency signals, to the terminal 4. This interference current can largely be suppressed by the third winding. The mode of operation is based on the fact that the impedance for the interference current is also high at the terminal 4 owing to this measure.

Further advantageous embodiments follow from the subclaims.

BRIEF DESCRIPTION OF THE DRAWINGS

Exemplary embodiments of the invention are now described below in more detail with reference to the attached drawings, in which.

DETAILED DESCRIPTION OF THE INVENTION

Figure 1:
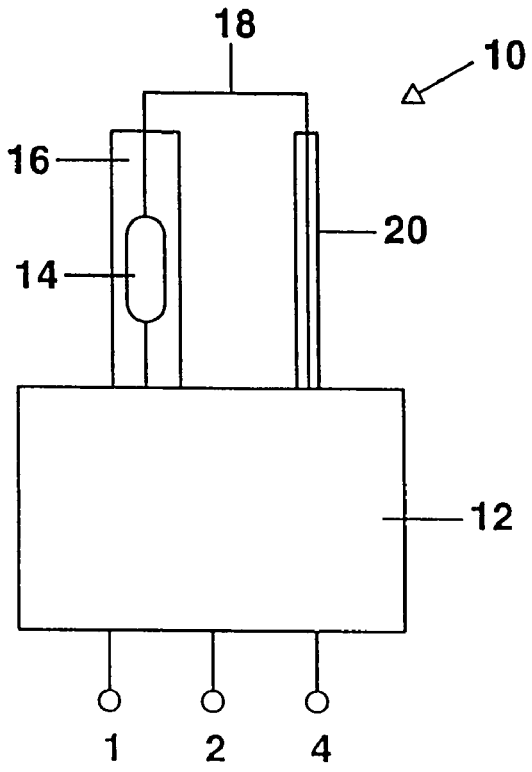
FIG. 1 PRIOR ART
FIG. 1 shows an embodiment of a high pressure discharge lamp as used, for example, in a headlight of a motor vehicle.
Figure 2:
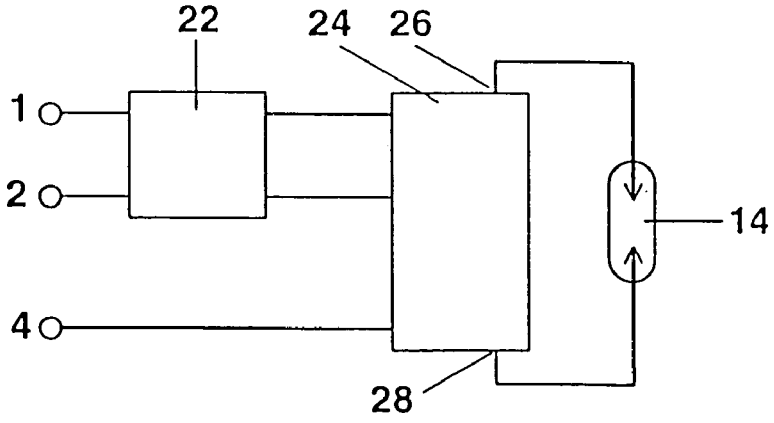
FIG. 2 shows a schematic of a first exemplary embodiment of a circuit arrangement according to the invention.

In FIG. 2, a first input terminal 1 is provided for connecting a DC voltage potential before starting, and for connecting an AC voltage after starting, a second input terminal 2 serving for connection to ground. The two lines are interconnected via a current-compensated choke 22. A starting signal, preferably a starting voltage, can be fed via a third input terminal 4. The output signals of the current-compensated choke 22, and the starting voltage applied at the third input terminal 4, pass into a block 24 that, on the one hand, comprises a starting circuit and, on the other hand, is designed such that, after starting, the high pressure discharge lamp 14 can be supplied with voltage during operation via the output terminals 26 and 28 of said block.

Figure 3:
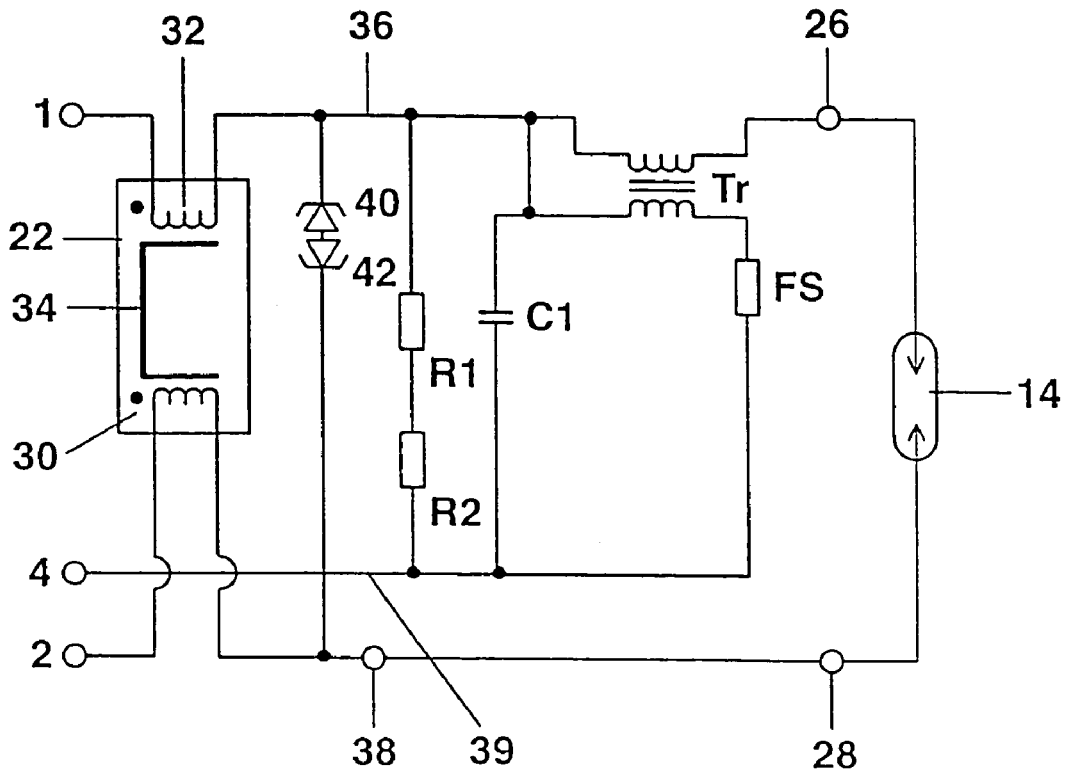
FIG. 3 shows the exemplary embodiment of FIG. 2 in a detailed illustration.

The illustration in FIG. 3 in turn permits the three input terminals 1, 2 and 4 to be seen, and also the first inductor 30 and the second inductor 32 of the current-compensated choke 22. It is well in evidence that the two inductors are wound on a common core 34 and oriented oppositely. The circuit also comprises a branch between the lines 36 and 38 in which a first diode 40 and a second diode 42 are connected back to back. The purpose of this branch is to protect the operating equipment of the lamp, in particular an electric ballast. Arranged between the lines 36 and 39 is the series circuit of two ohmic resistors R1 and R2 that serve to discharge the starting capacitor C1 after starting has been performed. The starting capacitor C1, which is arranged in parallel therewith, is charged for the purpose of starting with a specific voltage that suffices for igniting a spark gap FS. The voltage pulse is transmitted via a transformer Tr to the terminal 26 for the high pressure discharge lamp 14, which thereupon starts. As illustrated, voltage supply and starting device are advantageously coupled. As is self-evident to the person skilled in the art, the circuit arrangement according to the invention having the disadvantage of a relatively large space requirement can readily be implemented even with a separate design of voltage supply and starting device.

Figure 4:
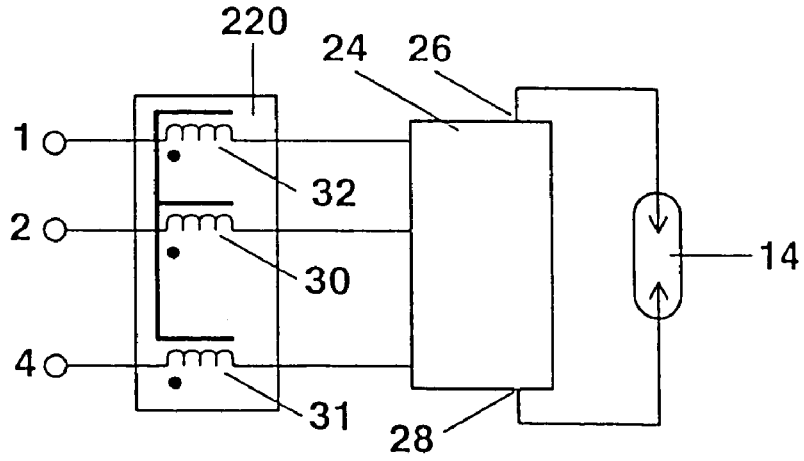
FIG. 4 shows a second exemplary embodiment of a circuit arrangement according to the invention, with a choke in the starting line.

In the exemplary embodiment illustrated in FIG. 4, components resembling those of FIG. 2 are provided with identical reference numerals and are not described once again. By contrast to the exemplary embodiment illustrated in FIG. 2, in the exemplary embodiment illustrated in FIG. 4, a third inductor 31, which is magnetically coupled to the first and to the second inductor, is further arranged in the starting line 4, that is to say in the line between the terminal for feeding a starting voltage and the starting device. Consequently, in practice there are three inductors wound onto one core. This embodiment reduces the parasitic interference current which, in the exemplary embodiment illustrated in FIG. 3, would flow via the diode branch from line 38 to line 36, and via the starting capacitor C1 to third input terminal 4.

FIG. 5 shows some embodiments of current-compensated chokes such as can be used in a circuit arrangement according to the invention, with the respective cores being wound with two windings for the sake of clarity. In FIG. 5*a*, a ferrite core 46 is provided with two windings which form the first inductor 30 and the second inductor 32 of the current-compensated choke 22. The start of the winding is marked in each case by A, and the end by E. If a highly insulating ferrite is selected, it is possible to wind thereon wires that are insulated from one another merely by commercially available insulating enamel. There is no need for any additional carrier, that is to say the wound ferrite core can be inserted directly, for example, using SMD technology, into the circuit. This results in a clear saving of space. FIG. 5*b* shows the use of a toroidal core 48 on which the two turns are wound. A further variant with a ferrite core 46 is illustrated in FIG. 5*c*.

Figure 5A:
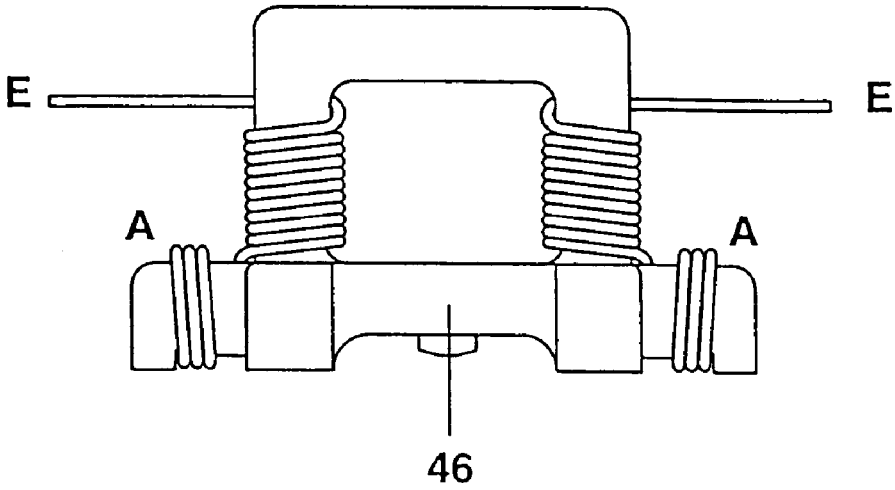
FIG. 5 shows various embodiments of a current-compensated choke for use in a circuit arrangement according to the invention.
Figure 5B:
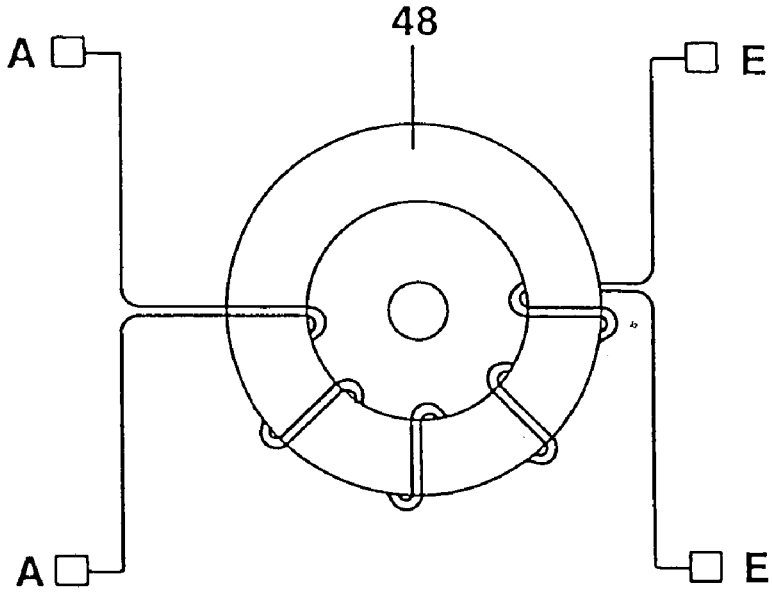
Figure 5C:
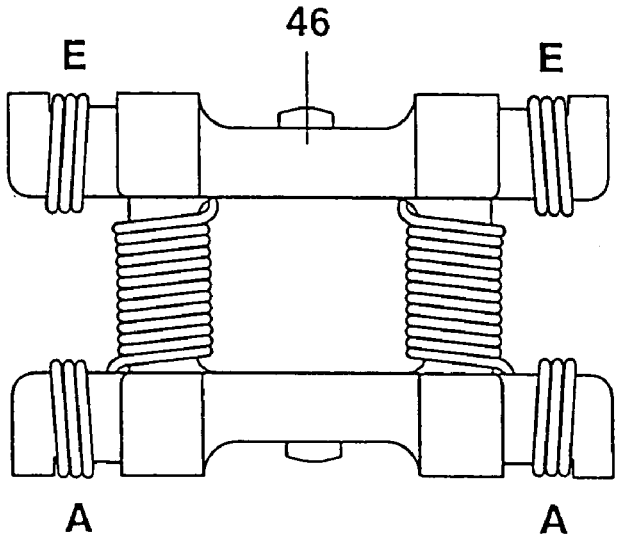
Figure 5D:
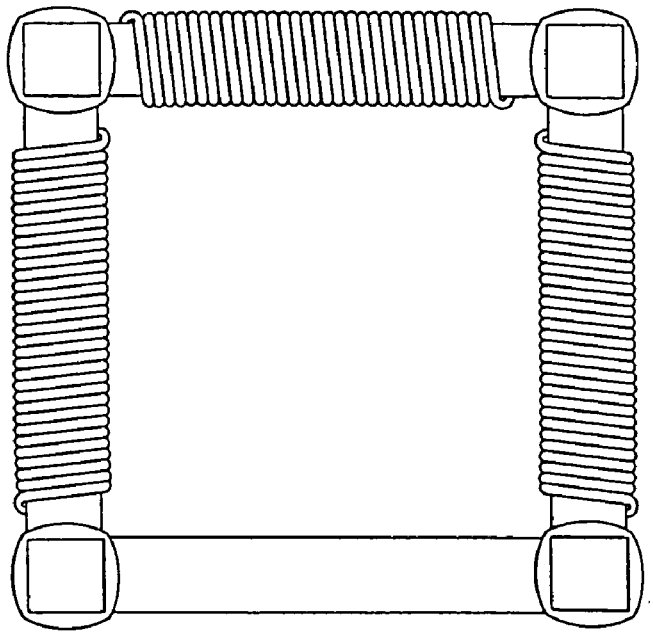
Figure 5E:
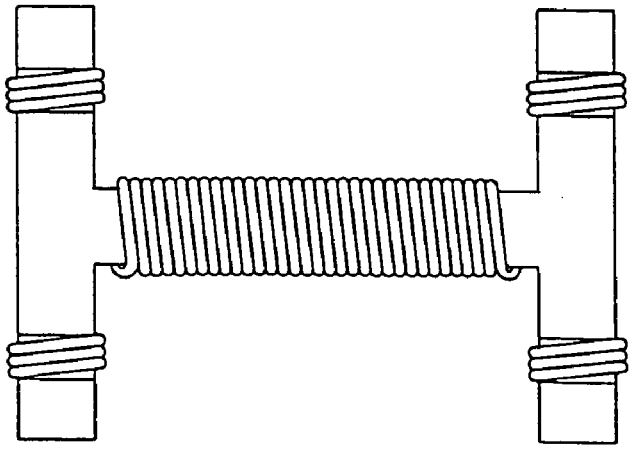
Figure 5F:
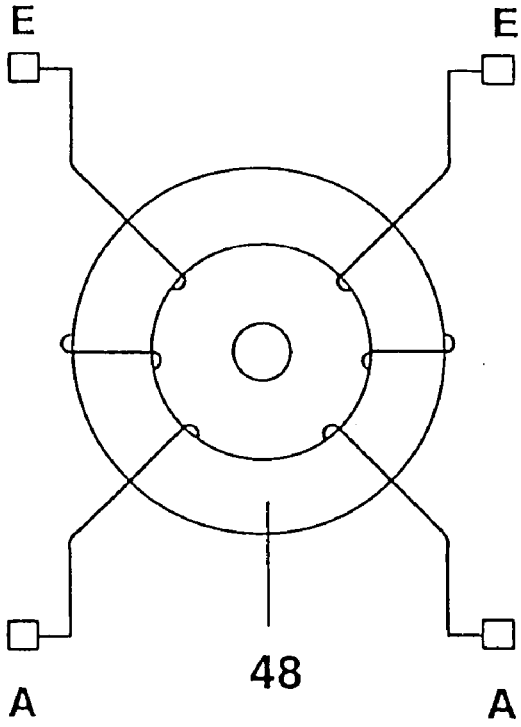
Figure 5G:
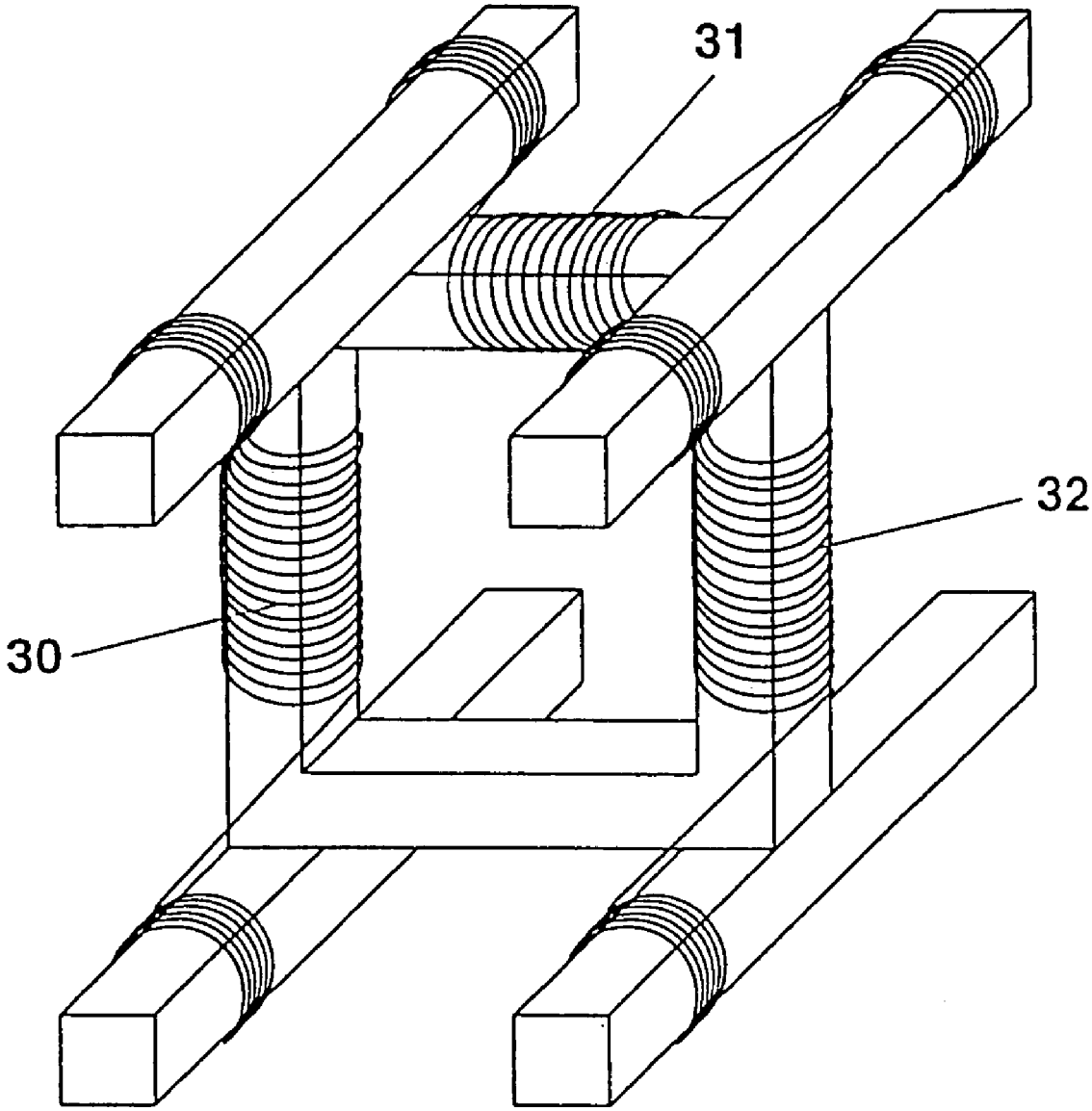

FIGS. 5*d*, 5*e* and 5*g* show a variant implementation with three chokes 30, 31, 32 on one ferrite core, FIG. 5*d* illustrating a side view, FIG. 5*e* a plan view and FIG. 5*g* a three-dimensional view. Finally, FIG. 5*f* shows a variant with a toroidal core 48 and a style of winding differing from that illustrated in FIG. 5*b*.

Figure 6A:
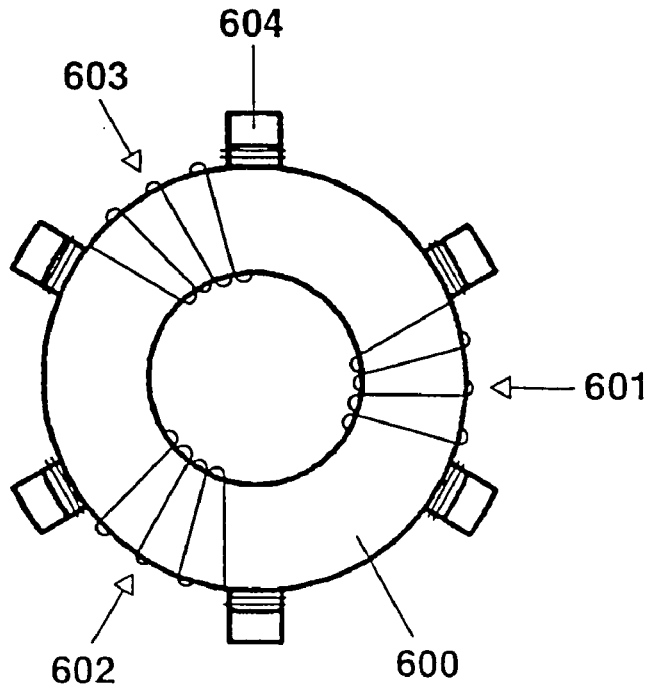
FIG. 6 shows an embodiment of a current-compensated choke for use in a circuit arrangement according to the invention, with a special toroidal core.
Figure 6B:
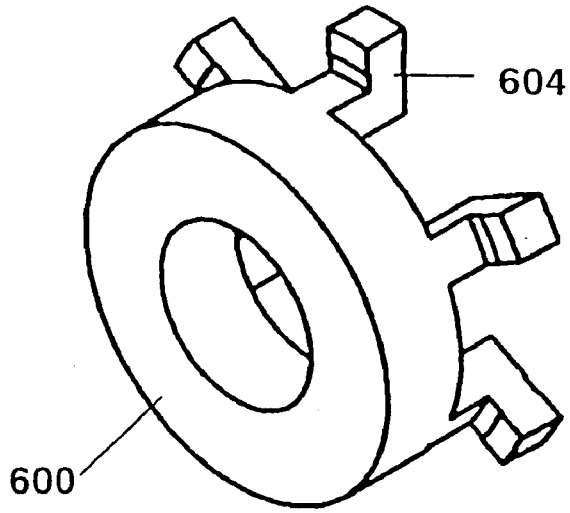

FIGS. 6*a* and 6*b* show a further variant of a current-compensated choke with a toroidal core 600. This variant has 3 chokes 601, 602 and 603. FIG. 6*a* shows the plan view. FIG. 6*b* shows a three-dimensional illustration. In the case of the three-dimensional illustration, only the ferrite body without choke windings is represented, for the sake of clarity. By contrast with the variants in FIGS. 5*b* and 5*f*, the ferrite body has projections 604 that serve to hold the wire ends of the choke windings. It is thereby possible to save a winding body. The projections are shaped such that the current-compensated choke can be fitted using SMD. Moreover, the projections have depressions that are intended to prevent the mounted wire ends from slipping off. The exemplary embodiment in FIG. 6 is not restricted to 3 choke windings. Rather, it is also possible to implement another number of choke windings. If appropriate, the number of the projections has then to be adapted. Again, the axial symmetry adhered to in the exemplary embodiment according to FIG. 6 is not compulsory. Rather, the choke windings can be arranged as desired on the toroidal core, for example in order to observe desired voltage spacings or couplings between the windings.

The invention claimed is:

1. A circuit arrangement for driving a high-pressure discharge lamp (14) having a first input terminal (1) for a first voltage potential, the first voltage potential constituting a DC voltage before starting, and an AC voltage after starting;

a second input terminal (2) for a second voltage potential;

a third input terminal (4) for feeding a starting voltage;

a first electrical connection, which provides at its first end a first output terminal (26) for the high-pressure discharge lamp (14), and which is coupled at its second end to the first input terminal (1) for the first voltage potential;

a second electrical connection, which provides at its first end a second output terminal (28) for the high-pressure discharge lamp (14), and which is coupled at its second end to the second input terminal (2) for the second voltage potential;

a first inductor (30) that is arranged in the second electrical connection; and a starting device (24) that is coupled on the input side at least to the third input terminal (4) for feeding a starting voltage, and that is coupled on the output side to one of the output terminals (26; 28) for the high-pressure discharge lamp; arranged in the first electrical connection is a second inductor (32), which forms a current-compensated choke (22) (common mode choke) together with the first inductor (30).

2. The circuit arrangement as claimed in claim 1, wherein the first voltage potential constitutes a supply voltage.

3. The circuit arrangement as claimed in claim 1, wherein the second voltage potential constitutes electrical ground.

4. The circuit arrangement as claimed in claim 1, wherein the first electrical connection constitutes a forward line.

5. The circuit arrangement as claimed in claim 1, wherein the second electrical connection constitutes a return line.

6. The circuit arrangement as claimed in claim 1, wherein the second inductor (32) is arranged between the first input terminal (1) for the first voltage potential and the starting device (24).

7. The circuit arrangement as claimed in claim 1, wherein the second inductor (32) is arranged between the starting device (24) and the first output terminal (26) for the high-pressure discharge lamp (14) that is coupled to the starting device (24).

8. The circuit arrangement as claimed in claim 1, wherein the first inductor (30) and the second inductor (32) comprise wires that are wound onto a common ferrite core (46; 48).

9. The circuit arrangement as claimed in claim 8, wherein the ferrite core (46; 48) is produced from a highly insulating material.

10. The circuit arrangement as claimed in claim 9, wherein the wires have insulating enamel as sole insulation.

11. The circuit arrangement as claimed in claim 8, wherein the wires have insulating enamel as sole insulation.

12. The circuit arrangement as claimed in claim 1, wherein arranged in the electrical connection between the third input terminal (4) for feeding a starting voltage and the first output terminal (26), assigned to said third input terminal (4), for the high-pressure discharge lamp (14) is a third inductor (31) which is magnetically coupled to the first and the second inductors (30; 32).

* * * * *